US010364620B2

(12) United States Patent
Ritter et al.

(10) Patent No.: US 10,364,620 B2
(45) **Date of Patent: *Jul. 30, 2019**

(54) DRILL ROD CLAMPING SYSTEM AND METHODS OF USING SAME

(71) Applicant: BLY IP INC., Salt Lake City, UT (US)

(72) Inventors: David Robert Ritter, North Bay (CA); Christopher Allen Wright, North Bay (CA); Anthony Charles William Markham, North Bay (CA)

(73) Assignee: BLY IP INC., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/057,240

(22) Filed: Aug. 7, 2018

(65) Prior Publication Data

US 2018/0347292 A1 Dec. 6, 2018

Related U.S. Application Data

(63) Continuation of application No. 15/387,981, filed on Dec. 22, 2016, now Pat. No. 10,066,451.

(Continued)

(51) Int. Cl.
*E21B 19/07* (2006.01)
*E21B 19/10* (2006.01)

(Continued)

(52) U.S. Cl.
CPC ..... *E21B 19/07* (2013.01); *E21B 19/10* (2013.01); *E21B 17/042* (2013.01);

(Continued)

(58) Field of Classification Search
CPC ..... E21B 19/07; E21B 19/10
See application file for complete search history.

(56) References Cited

U.S. PATENT DOCUMENTS 4,333,209 A 6/1982 Herst
5,848,647 A 12/1998 Webre et al.

(Continued)

FOREIGN PATENT DOCUMENTS

WO WO-2017/112845 A1 6/2017

OTHER PUBLICATIONS

International Search Report and Written Opinion dated Mar. 2, 2017 by the International Searching Authority for International Application No. PCT/US2016/068214, filed on Dec. 22, 2016 and published as WO 2017/112845 on Jun. 29, 2017 (Applicant—BLY IP Inc.) (6 Pages).

(Continued)

*Primary Examiner* — Kristyn A Hall
(74) *Attorney, Agent, or Firm* — Ballard Spahr LLP

(57) ABSTRACT

A drill rod clamping system for securing a drill rod in a selected position. The drill rod clamping system has a hollow spindle with an upper portion that defines axial slots and a base portion that defines at least one radial opening. A plurality of jaws are moveable radially inwardly to a drill rod gripping position and radially outwardly to a drill rod releasing position. Each jaw is received within a respective axial slot of the hollow spindle. An actuator moves the plurality of jaws between the drill rod gripping position and the drill rod releasing position. A compressed gas spring assembly exerts force on the actuator to close the jaws. A hydraulic operator exerts force on the actuator to overcome the force of the compressed gas spring assembly to open the jaws. The radial openings of the base portion of the spindle permit flushing of material flowing within the spindle.

20 Claims, 12 Drawing Sheets

Related U.S. Application Data

(60) Provisional application No. 62/271,052, filed on Dec. 22, 2015.

(51) Int. Cl.

| | |
|---|---|
| *E21B 17/042* | (2006.01) |
| *E21B 19/16* | (2006.01) |
| *E21B 19/24* | (2006.01) |
| *E21B 17/10* | (2006.01) |

(52) U.S. Cl.

CPC ..... *E21B 17/1042* (2013.01); *E21B 19/163* (2013.01); *E21B 19/24* (2013.01)

(56) References Cited

U.S. PATENT DOCUMENTS

| | | | | |
|---|---|---|---|---|
| 6,311,792 | B1 | 11/2001 | Scott et al. | |
| 10,066,451 | B2 * | 9/2018 | Ritter | E21B 19/07 |
| 2003/0116360 | A1 | 6/2003 | Jonsson et al. | |
| 2008/0210063 | A1 * | 9/2008 | Slack | E21B 19/06 81/420 |
| 2017/0175463 | A1 | 6/2017 | Ritter et al. | |

OTHER PUBLICATIONS

International Preliminary Report on Patentability dated Jun. 26, 2018 by the International Searching Authority for International Application No. PCT/US2016/068214, filed on Dec. 22, 2016 and published as WO 2017/112845 on Jun. 29, 2017 (Applicant—BLY IP Inc.) (5 Pages).

Non Final dated Dec. 18, 2017 by the USPTO for U.S. Appl. No. 15/387,981, filed Dec. 22, 2016 and granted as U.S. Pat. No. 10,066,451 on Sep. 4, 2018 (Inventor—David Robert Ritter) (8 Pages).

Response to Non Final dated Mar. 9, 2018 to the USPTO for U.S. Appl. No. 15/387,981, filed Dec. 22, 2016 and granted as U.S. Pat. No. 10,066,451 on Sep. 4, 2018 (Inventor—David Robert Ritter) (9 Pages).

Notice of Allowance dated May 7, 2018 by the USPTO for U.S. Appl. No. 15/387,981, filed Dec. 22, 2016 and granted as U.S. Pat. No. 10,066,451 on Sep. 4, 2018 (Inventor—David Robert Ritter) (5 Pages).

* cited by examiner

DRILL ROD CLAMPING SYSTEM AND METHODS OF USING SAME

CROSS-REFERENCE TO RELATED APPLICATION

This application is a continuation of U.S. application Ser. No. 15/387,981 filed Dec. 22, 2016, which claims priority to, and the benefit of, the filing date of U.S. Provisional Patent Application No. 62/271,052, filed Dec. 22, 2015, which applications are incorporated by reference herein in their entirety.

FIELD

The disclosed invention relates to devices, systems, and methods for securing a drill string (or drill rod) in a desired axial position.

BACKGROUND

In conventional drilling systems, a drill string may include a series of connected drill rods. The drill rods may be assembled section-by-section to advance the drill string into a formation. In further detail, the drill string may be connected to a drill head or other driving mechanism configured to advance the drill string to a desired depth in the formation. The driving mechanism may, for example, advance the drill string until a trailing portion of the drill string is proximate an opening of a borehole formed by the drill string.

After the drill string is at a desired depth, a clamp (such as a foot clamp) may grasp the drill string, which may help prevent inadvertent loss of the drill string down the borehole. With the clamp grasping the drill string, the driving mechanism may be disconnected from the drill string. An additional drill rod may then be connected to the driving mechanism and to a drill rod that forms the trailing portion of the drill string. After such connection, the clamp's grasp on the drill string may be released, and the driving mechanism may advance the drill string further into the formation to a greater desired depth. This process of grasping the drill string, disconnecting the driving mechanism, connecting an additional drill rod, releasing the grasp, and advancing the drill string to a greater depth may be repeatedly performed to drill deeper and deeper into the formation.

In conventional drill rod clamps, the jaws of the clamps are moved to a closed position gripping the drill rod under the force of large a number of preloaded coiled springs or Belleville washers. To provide adequate drill gripping force to rotate the drill string in the case of the coiled springs, a large number of springs are required, e.g. some 22 coiled springs, which have a significant height. Similarly, with the Belleville washers, a large number of stacks of washers, e.g. 18 stacks, of heights comparable to the coiled springs are required. To accommodate the large number of springs or washer stacks conventional chucks are necessarily large, heavy and costly.

Alternative drill rod clamp designs typically use actuators to generate movement of the jaws of the clamp. However, these alternative designs often have a large profile comparable to that of clamps having coiled springs or Belleville washers. Further, actuated drill rod clamp designs often include external actuators that are prone to damage during use.

Still further, usage of existing drill rod clamps often leads to undesired dispersal of water, mud, and cuttings toward pistons acting to effect movement of the jaws of the clamps. Additionally, existing drill rod clamps are prone to jamming and damage due to their inability to adequately disperse mud and cuttings that are positioned above the jaws of the clamps.

Thus, there is a need in the pertinent art for drill rod clamp assemblies and methods that can address one or more of the above-described limitations.

SUMMARY

Described herein, in various aspects, is a drill rod clamping system for securing a drill rod in a selected position. The drill rod clamping system can have a longitudinal axis, a hollow spindle, a plurality of jaws, an actuator, a compressed gas spring assembly, and a hydraulic operator. The hollow spindle can have a central bore, an inner surface, an outer surface, a base portion and an upper portion extending upwardly from the base portion relative to the longitudinal axis. The upper portion of the hollow spindle can define a plurality of axial slots that extend between the inner and outer surfaces of the hollow spindle, and the base portion of the hollow spindle can define at least one opening that extends between the inner and outer surfaces of the hollow spindle. The plurality of jaws can be coupled to the spindle and be moveable radially inwardly to a closed drill rod gripping position and radially outwardly to an open drill rod releasing position. Each jaw can be at least partially received within a respective axial slot of the upper portion of the hollow spindle. The actuator can be configured to move the plurality of jaws between the closed drill rod gripping position and the open drill rod releasing position. The compressed gas spring assembly can be configured to exert sufficient force on the actuator to close the jaws of the drill rod clamping system. The compressed gas spring assembly can have a plurality of compressed gas springs, and each compressed gas spring can include a cylinder containing compressed gas and a piston urged by the compressed gas outwardly of the cylinder to the end of its stroke. The hydraulic operator can be configured to exert force on the actuator to overcome the force of the compressed gas spring assembly to effect opening of the jaws of the drill rod clamping system. The at least one opening of the base portion of the hollow spindle can permit flushing of material flowing within the central bore of the hollow spindle relative to the longitudinal axis.

DESCRIPTION OF THE DRAWINGS

FIG. 2A depicts the drill rod clamping system in a jaws-closed position, whereas FIG. 2B depicts the drill rod clamping system in a jaws-open position.

DETAILED DESCRIPTION

Figure 1A:
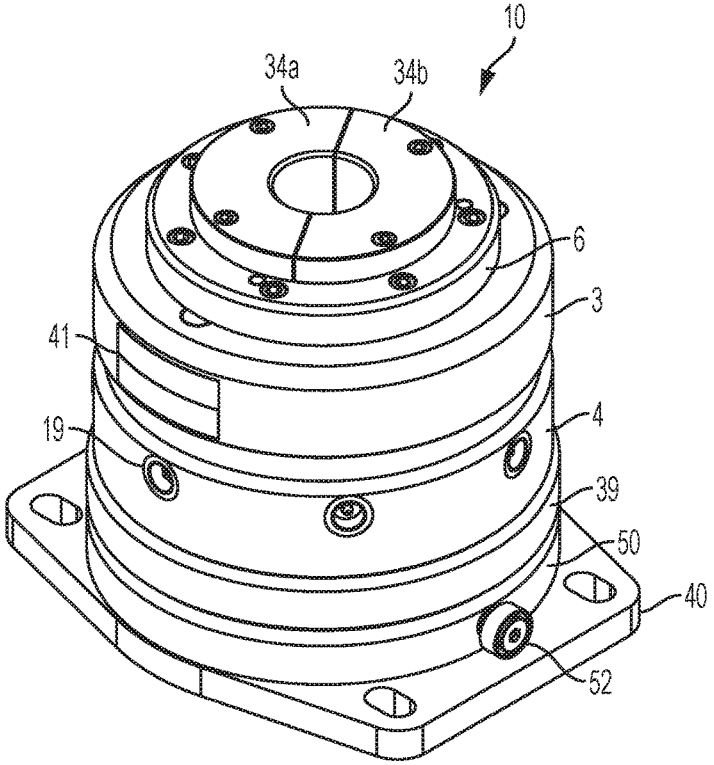
FIGS. 1A-1B are perspective and top plan views of an exemplary drill rod clamping system as disclosed herein.
Figure 1B:
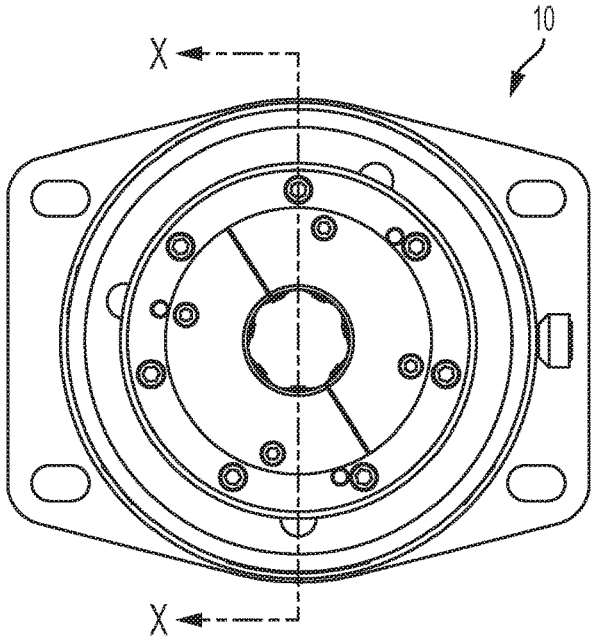
Figure 1C:
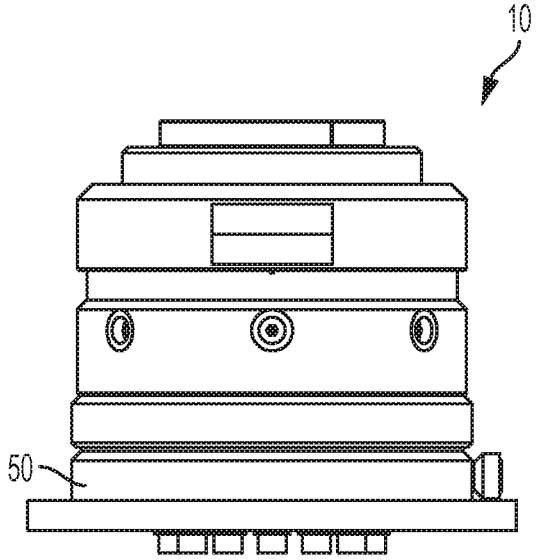
FIG. 1C is a side elevational view of the drill rod clamping system of FIG. 1A, with the system shown in a jaws-closed position.
Figure 1D:
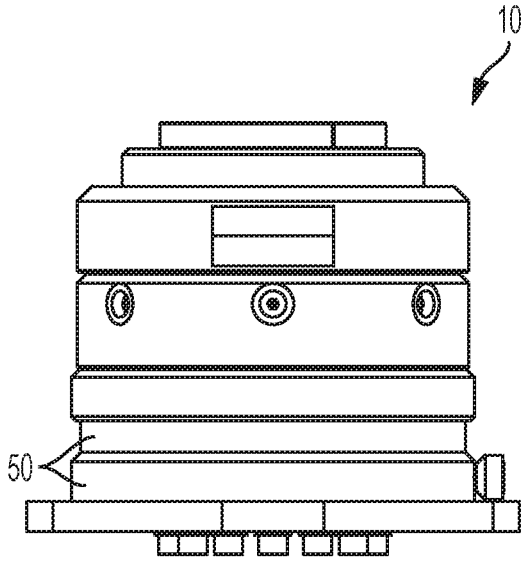
FIG. 1D is a side elevational view of the drill rod clamping system of FIG. 1A, with the system shown in a jaws-open position.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a", "an", and "the" include plural referents unless the context clearly dictates otherwise. For example, use of the term "an opening" can refer to one or more of such openings.

All technical and scientific terms used herein have the same meaning as commonly understood to one of ordinary skill in the art to which this invention belongs unless clearly indicated otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry.

Disclosed herein, in various aspects and with reference to FIGS. 1A-10 is a drill rod clamping system 10 for securing a drill rod (or a drill string) 10 in a selected position. In these aspects, it is contemplated that the selected position can correspond to a selected axial position relative to a longitudinal axis 11 of the drill rod clamping system 10. Optionally, when the longitudinal axis 11 of the drill rod clamping system 10 is aligned with a drilling axis, the selected position can correspond to a selected axial position relative to the drilling axis.

In exemplary aspects, it is contemplated that the disclosed drill rod clamping system 10 can be provided as a component of a drilling system that can be used to drill into a formation. The drilling system can include a drill string formed from a plurality of drill rods. The drill rods can be rigid and/or metallic, or alternatively can be constructed from other suitable materials. The drill string can include a series of connected drill rods that can be assembled section-by-section as the drill string advances into the formation. Alternatively, it is contemplated that the drill string can be a coiled tube drill string. A drill bit can be secured to the distal end of the drill string. As used herein, the terms "leading" and "distal end" refer to the end of the drill string including the drill bit, while the terms "trailing" and "proximal" refer to the end of the drill string opposite the drill bit.

The drilling system can include a drill rig that can rotate and/or push the drill bit, the drill rods and/or other portions of the drill string into the formation. The drill rig can include a driving mechanism, for example, a rotary drill head, a sled assembly, and a mast. The drill head can be coupled to the drill string, and can rotate the drill bit, the drill rods and/or other portions of the drill string. If desired, the rotary drill head can be configured to vary the speed and/or direction that it rotates these components. The sled assembly can move relative to the mast. As the sled assembly moves relative to the mast, the sled assembly can provide a force against the rotary drill head, which can push the drill bit, the drill rods and/or other portions of the drill string further into the formation, for example, while they are being rotated.

It will be appreciated, however, that the drill rig does not require a rotary drill head, a sled assembly, a slide frame or a drive assembly and that the drill rig can include other suitable components. It will also be appreciated that the drilling system 10 does not require a drill rig and that the drilling system can include other suitable components that can rotate and/or push the drill bit, the drill rods and/or other portions of the drill string into the formation. For example, sonic, percussive, or down hole motors can be used to rotate or advance portions of the drill string.

Optionally, the drilling system can include a drill rod guide in addition to a drill rod clamping system as disclosed herein. It is contemplated that the drill rod guide can guide and align a first drill rod with a second drill rod to allow for connection of the first and second drill rods together. The drill rod guide can ensure that the drill rods are not misaligned, and thus, avoid damage to the drill rods that is commonly associated with attempting to make (i.e., join) misaligned drill rods.

In further detail, the driving mechanism can advance the drill string and particularly a first drill rod until a trailing portion of the first drill rod is proximate an opening of a borehole formed by the drill string. Once the first drill rod is at a desired depth, the drill rod clamping system 10 can grasp the first drill rod, which can help prevent inadvertent loss of the first drill rod and the drill string down the borehole. With the drill rod clamping system 10 grasping the first drill rod, the driving mechanism can be disconnected from the first drill rod. An additional or second drill rod can then be connected to the driving mechanism and advanced into the drill rod guide. The drill rod guide can align the second drill rod with the first drill rod that forms the trailing portion of the drill string. In particular, the drill rod guide can be configured to align the central axis of the second drill rod with the central axis of the first drill rod. Once aligned, a joint between the first drill rod and the second drill rod can be made by threading the second drill rod into the first drill rod.

After the second drill rod is connected to the driving mechanism and the first drill rod, the drill rod clamping system 10 can release the drill string. The driving mechanism can advance the drill string further into the formation to a greater desired depth. This process of grasping the drill string, disconnecting the driving mechanism, connecting an additional drill rod, releasing the grasp, and advancing the drill string to a greater depth can be repeatedly performed to drill deeper and deeper into the formation.

The first and second drill rods can include threads configured to engage and mate to connect the drill rods. One will appreciate in light of the disclosure herein that the one or more threads of the second drill rod can be located on a pin or male portion at a leading portion of the second drill rod. Similarly, the one or more threads of the first drill rod can be located in a box or female portion at the trailing portion of the drill rod. It will be appreciated, however, that the threads can be formed in other suitable portions of the drill rods, or the pins and boxes of the drill rods can be reversed. It will also be appreciated that the drill rods do not require threads and may be connected using fasteners, connectors, adhesives, welds and/or any other suitable means. In use, it is contemplated that the disclosed drill rod clamp assembly can provide torsional resistance for making and/or breaking drill rod joints.

The Drill Rod Clamping System

In one aspect, and with reference to FIGS. 1A-10, the drill rod clamping system 10 can comprise a hollow spindle 1 having a central bore 60, an inner surface 62, an outer surface 64, a base portion 2*b* and an upper portion 2*a* extending upwardly from the base portion relative to the longitudinal axis 11. In these aspects, the upper portion 2*a* can define a plurality of axial slots 12*a* that extend radially between the inner and outer surfaces of the hollow spindle 1, and the base portion 2*b* can define at least one opening 12*b* that extends radially between the inner and outer surfaces of the hollow spindle. Optionally, in exemplary aspects, the at least one opening 12*b* of the base portion 2*b* of the spindle 1 can comprise a plurality of circumferentially spaced openings. In these aspects, the base portion 2*b* of the spindle 1 can comprise a distal surface 68, and each opening 12*b* of the base portion of the spindle can optionally comprise a slot that extends upwardly from the distal surface of the base portion of the spindle.

Figure 2B:
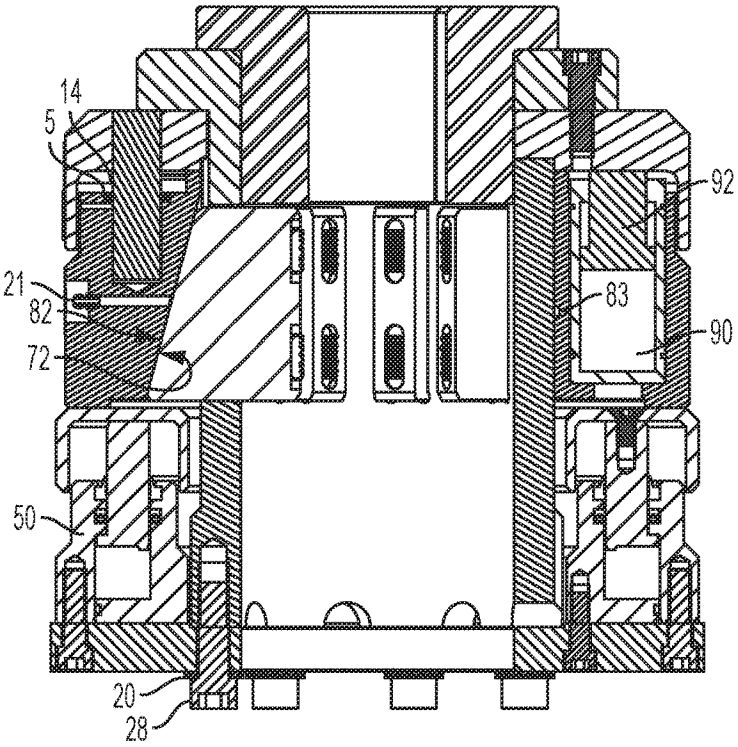
FIGS. 2A-2B are cross-sectional views of the drill rod clamping system of FIG. 1A, taken at section line X-X as shown in FIG. 1B.
Figure 2A:
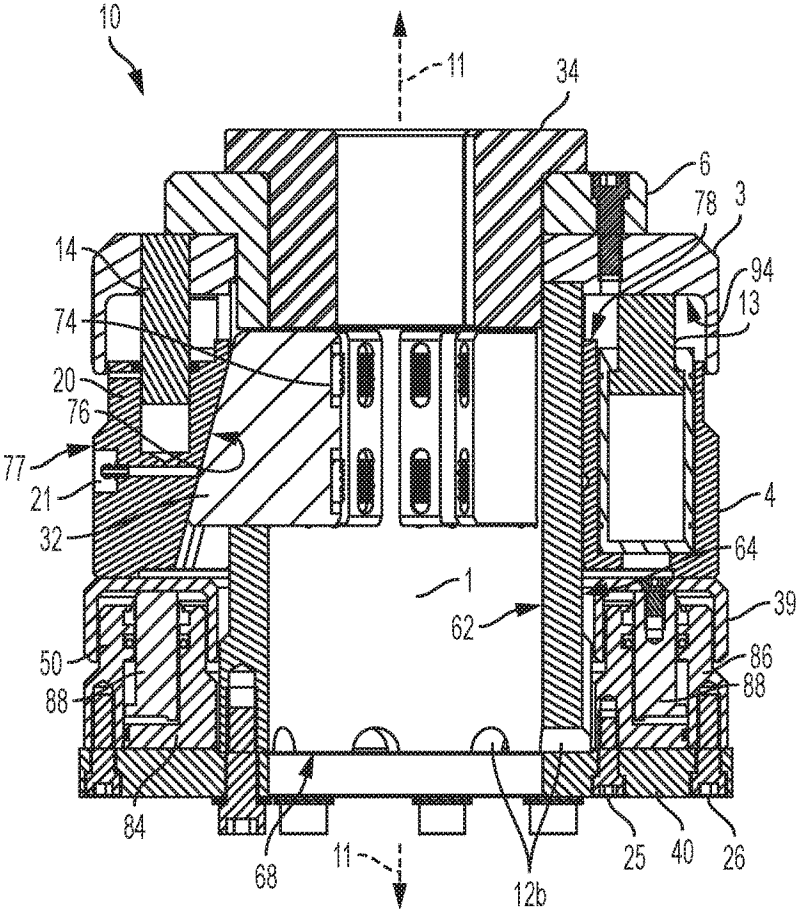
Figure 8:
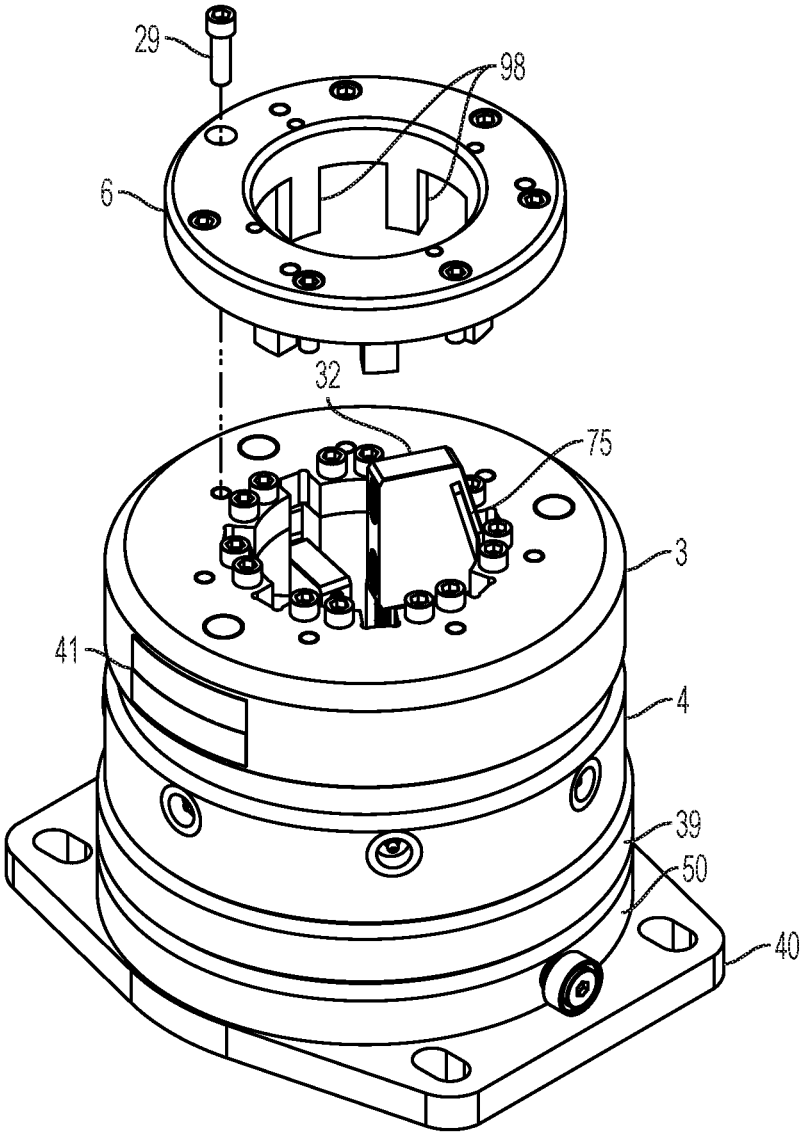
FIG. 8 is a perspective view depicting the attachment of a jaw retainer to the gas spring retainer of an exemplary drill rod clamping system as disclosed herein.

In another aspect, and with reference to FIGS. 2B and 8, the drill rod clamping system 10 can comprise a plurality of jaws 32 that are coupled to the spindle 1 and moveable radially inwardly to a closed drill rod gripping position and radially outwardly to an open drill rod releasing position. In this aspect, each jaw 32 can be at least partially received within a respective axial slot 12*a* of the upper portion 2*a* of the hollow spindle 1. In exemplary aspects, each jaw 32 of the plurality of jaws can be mounted within a respective axial slot 12*a* of the upper portion 2*a* of the hollow spindle 1.

Figure 5:
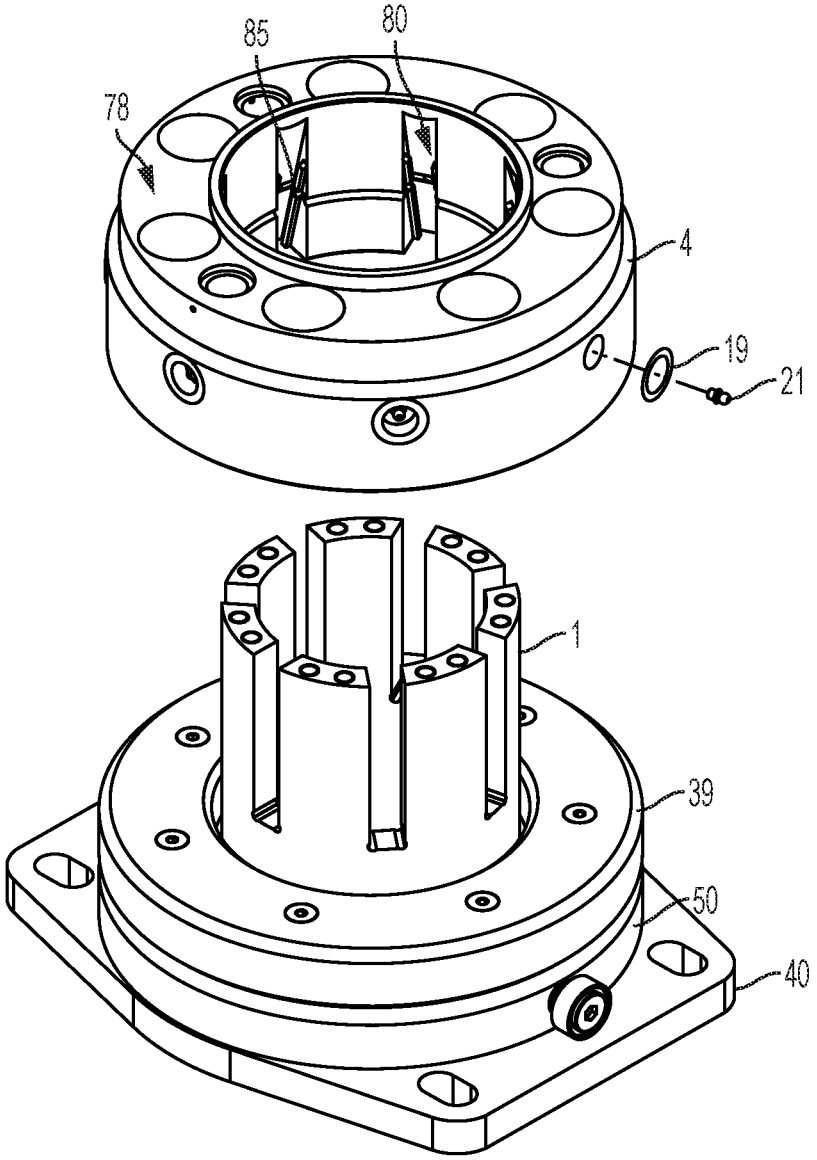
FIG. 5 is a perspective view depicting the alignment of a jaw bowl with the ring cylinder of an exemplary drill rod clamping system as disclosed herein.

In a further aspect, and with reference to FIGS. 2B and 5, the drill rod clamping system 10 can comprise an actuator 20 configured to move the plurality of jaws 32 between the closed drill rod gripping position and the open drill rod releasing position. In exemplary aspects, the actuator 20 can be slideably mounted on the spindle 1. In further exemplary aspects, the plurality of jaws 32 and the actuator 20 can have complementary engagement portions 72, 82 that are arranged to provide inward radial movement to the jaws upon upward axial movement of the actuator and to maintain alignment of the jaws relative to the longitudinal axis. Optionally, in these aspects, the complementary engagement portions 72, 82 can comprise inclined key ways 75 defined by each jaw and complementary inclined keys 85 defined by the actuator, with the inclined keys of the actuator being configured for sliding engagement with the key ways of the jaws. Alternatively, the complementary engagement portions 72, 82 can comprise inclined key ways defined by the actuator and complementary inclined keys defined by the plurality of jaws, with the inclined keys of the jaws being configured for sliding engagement with the key ways of the actuator.

Figure 6:
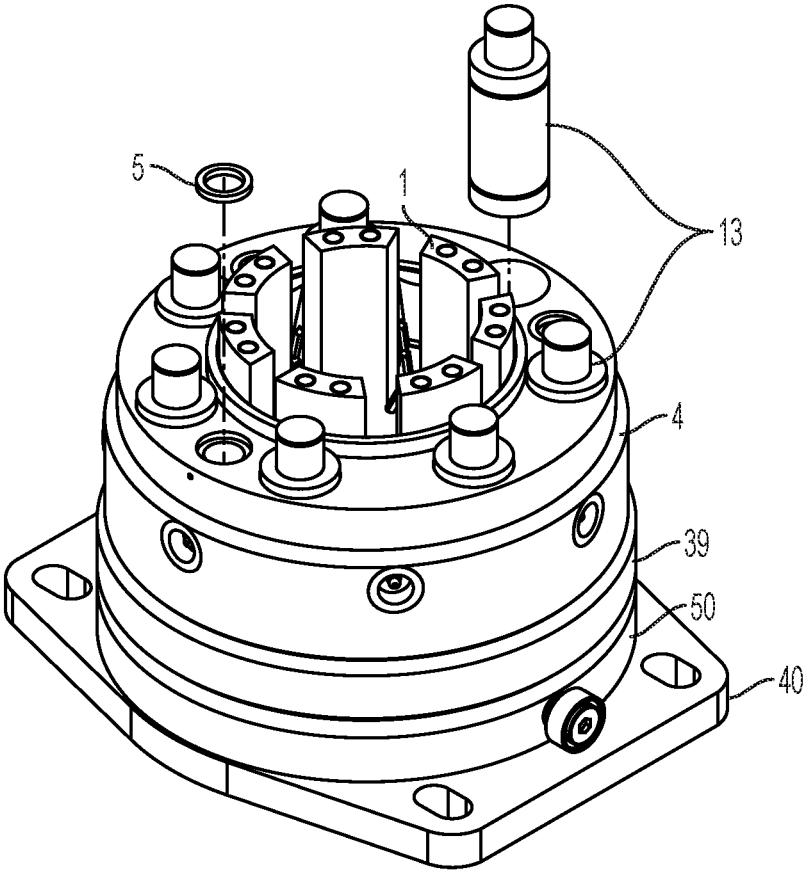
FIG. 6 is a perspective view depicting the positioning of gas springs within receptacles defined within a jaw bowl of an exemplary drill rod clamping system as disclosed herein.
Figure 7:
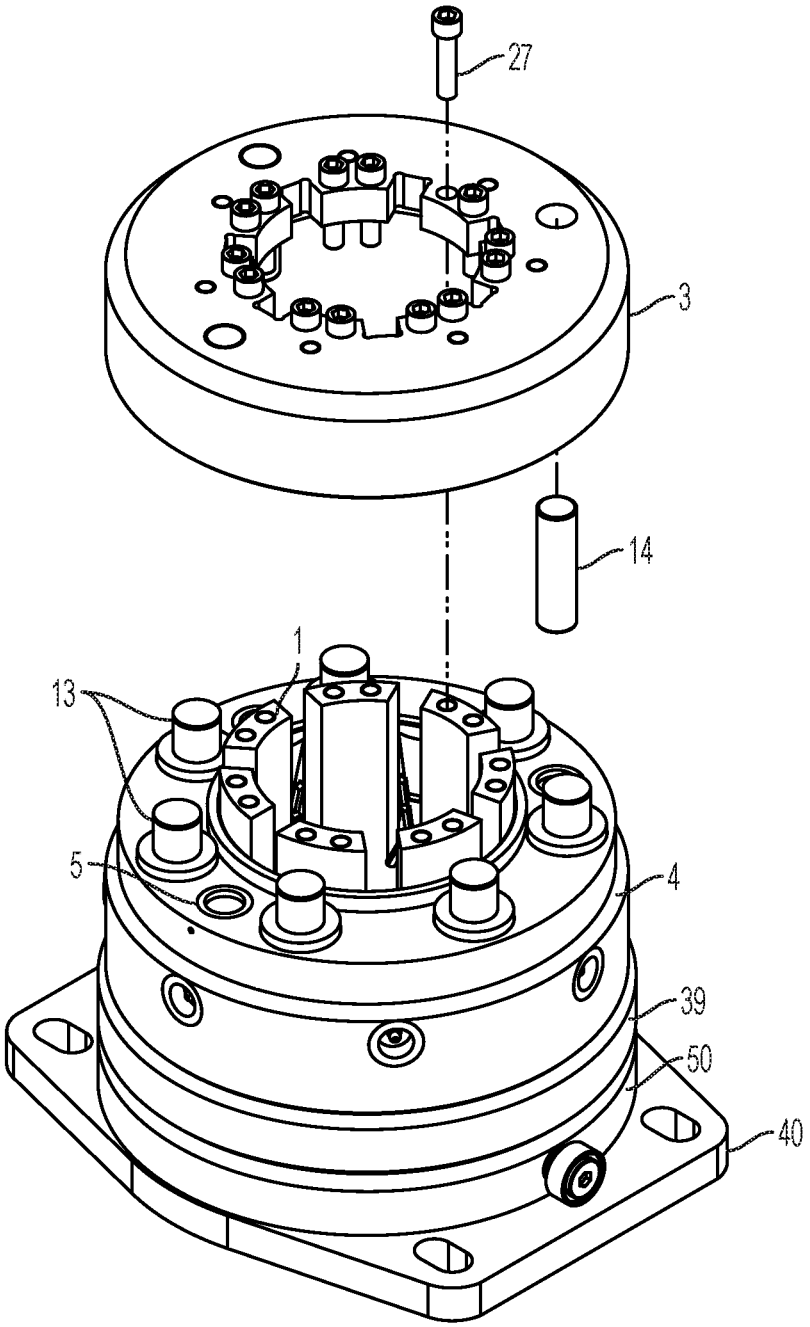
FIG. 7 is a perspective view depicting the attachment of a gas spring retainer to the actuator of an exemplary drill rod clamping system as disclosed herein.

In an additional aspect, and with reference to FIGS. 2B and 6-7, the drill rod clamping system 10 can comprise a compressed gas spring assembly configured to exert sufficient force on the actuator 20 to close the jaws 32 of the drill rod clamping system. Optionally, in this aspect, the compressed gas spring assembly can comprise a plurality of compressed gas springs 13. It is contemplated that each compressed gas spring can optionally comprise a cylinder 90 containing compressed gas and a piston 92 urged by the compressed gas outwardly of the cylinder to the end of its stroke.

In still another aspect, the drill rod clamping system 10 can comprise a hydraulic operator 50 configured to exert force on the actuator 20 to overcome the force of the compressed gas spring assembly to effect opening of the jaws 32 of the drill rod clamping system. In exemplary aspects, the hydraulic operator 50 can be a hydraulic cylinder. In further exemplar aspects, the hydraulic operator 50 can comprise a port 52 for receiving hydraulic fluid upon activation of the hydraulic operator.

In use, it is contemplated that the at least one opening 12*b* of the base portion 2*b* of the hollow spindle 1 can be configured to permit flushing of material (e.g., internal mud and cuttings) flowing within the central bore of the hollow spindle relative to the longitudinal axis 11. Optionally, in exemplary aspects, the drill rod clamping system 10 does not rotate, even if the drill string (or drill rod) is configured to rotate. In further exemplary aspects, upon deactivation of the hydraulic operator 50, the force exerted by the hydraulic operator on the actuator 20 is removed to allow the compressed gas spring assembly to drive the plurality of jaws 32 to the drill rod gripping position. That is, the hydraulic operator 50 does not actually drive movement of the jaws 32 to the rod gripping position—rather, the force applied by the hydraulic operator is simply removed, thereby allowing the gas springs 13 to force the jaws to the rod gripping position.

In exemplary aspects, the actuator 20 can comprise a bowl 4 that is slideable relative to the plurality of jaws 32 to open and close the jaws. In these aspects, the bowl 4 can have an upper surface 78, and the cylinders of the compressed gas springs 13 of the compressed gas spring assembly can be embedded in the upper surface of the bowl. Optionally, in further exemplary aspects, the drill rod clamping system 10 can further comprise a gas spring retainer 3 that circumferentially surrounds the hollow spindle 1 and at least partially encloses the compressed gas springs 13. In these aspects, the gas spring retainer 3 can have an inner stop surface 94, and the pistons 92 of the compressed gas springs 13 of the compressed gas spring assembly can be configured to engage the stop surface to urge the actuator away from the stop surface to the jaw closing position. In exemplary aspects, the gas spring retainer has an inner surface that defines a central bore and a plurality of recessed slots that extend radially outwardly from the central bore, wherein the recessed slots of the gas spring retainer are positioned in alignment with corresponding axial slots of the spindle.

In another aspect, the drill rod clamping system can further comprise a base plate 40 secured to the base portion 2*b* of the spindle 1. In this aspect, the base plate 40 can define a central opening 96 positioned in alignment with the central bore of the spindle. It is further contemplated that the base plate 40 can extend radially outwardly from the outer surface of the base portion 2*b* of the spindle 1.

In exemplary aspects, the jaw bowl 4 can have jaw receiving undercut slots 80 for registering with the axial slots in the upper portion of the spindle. In these aspects, the jaws can project through the spindle slots into the central bore of the spindle to grip a drill rod and to be withdrawn from the drill rod gripping position upon sliding motion of the jaw bowl.

Optionally, it is contemplated that the gas springs 13 can be configured to effect downward movement of the jaw bowl 4, while the hydraulic operator can be configured to effect upward movement of the jaw bowl. However, it is contemplated that the orientation of the gas springs can be reversed, in which case the hydraulic operator would be configured to effect downward movement of the jaw bowl and the gas springs would be configured to effect upward movement of the jaw bowl.

In further exemplary aspects, the drill rod clamping system can further comprise a jaw retainer 6 having depending legs 98 projecting downwardly for complementary receipt within the axial slots 12*a* of the spindle to overlie the jaws 32 and prevent upward movement thereof.

Optionally, in some aspects, the jaw bowl 4 can have an inner surface 76, an outer surface 77, and at least one radial grease feed passageway/fitting 21 extending between the inner and outer surfaces and positioned in communication with the jaw receiving slots 80. In these aspects, the jaw bowl 4 can optionally define a circumferential grease passageway 83, and the jaw receiving slots 80 can be interconnected by the circumferential grease passageway.

In further exemplary aspects, the jaw receiving slots of the jaw bowl and the plurality of jaws can have complementary engagement portions. In these aspects, downward movement of the jaw bowl can positively advance the jaws into the drill rod gripping position, and upward movement of the jaw bowl can positively withdraw the jaws from the drill rod gripping position. Optionally, it is contemplated that the drill rod clamping system can further comprise a plurality of locating pins that are interposed between the jaw bowl and the gas spring retainer to locate the jaw bowl so that the jaw receiving slots complementarily register with the axial slots in the top portion of the spindle.

Optionally, in still further exemplary aspects, the jaws 32 can comprise grippers 74 that are configured to grip a drill rod. In these aspects, the grippers 74 can optionally have an angled tooth pattern, with the angled tooth pattern comprising a plurality of teeth that have respective plough paths through rod material when gripping a drill rod.

In exemplary aspects, the actuator 20 can comprise an inner ring cylinder 84 that circumferentially surrounds the base portion 2*b* of the spindle 1, an outer ring cylinder 86 that circumferentially surrounds the inner ring cylinder, and a ring cylinder piston 88 positioned radially between the inner and outer ring cylinders. In these aspects, the ring cylinder piston 88 can be configured for upward and downward movement relative to the longitudinal axis 11 to selectively engage the gas springs 13. Rather than having an inner and an outer ring cylinder, it is contemplated that the actuator 20 can comprise a single ring cylinder that circumferentially surrounds the base portion of the spindle. Thus, it is contemplated that the actuator 20 can comprise at least one ring cylinder, such as a single ring cylinder or a plurality of radially spaced ring cylinders.

In additional aspects, the drill rod clamping system 10 can further comprise a ring cylinder cover 39 positioned between the actuator 20 and the jaw bowl 4. In these aspects, the ring cylinder cover can circumferentially surround the spindle and be configured to direct material (e.g., internal water, mud, cuttings, and the like) radially inwardly (toward the spindle) and away from the ring cylinder piston. In still further exemplary aspects, it is contemplated that the actuator can be selectively replaceable independently of the other components of the drill rod clamping system. In still further exemplary aspects, the drill rod clamping system does not comprise an external actuator.

In use, the disclosed drill rod clamping system 10 can be used to selectively grip and release a drill rod (or drill string). As further described herein, it is contemplated that activation of the hydraulic operator can effect movement of the jaws to a rod releasing position, whereas deactivation of the hydraulic operator can remove the applied hydraulic force and allow the compressed gas spring assembly to drive the jaws to the rod closing position.

With the utilization of compressed gas to provide the force to close the jaws of the clamping system on a drill rod of a drill string, it has been found that the closing pressure can be both accurately set yet altered as desired. Further, the jaws can be moved uniformly to close on the drill rod to provide a balanced or uniform grip around the rod while maintaining an essentially constant gripping force throughout the jaw travel. As a result, it is contemplated that the jaws can grip rods of different diameters with essentially equal and sufficient force to provide the requisite torque transfer regardless of such variations in drill rod diameters. More particularly, in keeping with this aspect of the invention, the clamp actuator which moves axially longitudinally of the spindle to open and close the jaws is operated in the jaw closing direction by a source of compressed gas in the form of a plurality of compressed gas springs disposed symmetrically around the actuator and acting between the jaw actuator and a suitable stop surface or clamp spring retainer fixed to the spindle.

Compressed gas springs are commercially available and comprise cylinders into which compressed gas (e.g., Nitrogen) is introduced. The compressed gas forces a slideable small diameter cylindrical plunger or piston outwardly to a maximum position. Under the application of a force on the outer end of the plunger, the plunger can be displaced telescopically back into the cylinder against the force of the contained compressed gas. The travel of the plunger from its point of maximum projection to its point where it is fully retracted is the stroke of the plunger. Alternatively, it is contemplated that the gas springs 13 can be built into the actuator with a common pressure manifold.

It will be understood that on contact with the plunger of a gas spring the full force of the compressed gas in the cylinder is available to resist inward movement of the plunger whereas in a coiled spring, unless it is preloaded, there is no force on simple contact with the spring. Moreover, gas springs provide a nearly constant force resisting inward movement throughout the stroke of the plunger.

In addition, as the compressed gas within the cylinder of the gas spring is trapped from escaping, unlike coiled springs or washers whose force deteriorates with age and use, the force exerted by the gas spring remains constant with time and regardless of the frequency of its use. On the other hand, the force of the spring can be altered as desired by introducing a measured amount of compressed gas (e.g., Nitrogen gas), into the cylinder or exhausting a measured amount if desired. Thus, each spring can be calibrated to provide a precise spring force so that a number of identical gas springs having precisely the same spring force and other characteristics can be provided.

As further disclosed herein, the jaws are moved by a jaw actuator in the form of a bowl or ring which cooperates with the jaws which are arranged at equally spaced intervals symmetrically around the spindle in a circular configuration. The jaw actuator or bowl opens the jaws as it is moved upwardly under hydraulic force and closes the jaws as it is moved downwardly under the force of a highly efficient compact arrangement of gas springs. More particularly, according to the preferred form of the invention utilizing gas springs, the gas spring arrangement comprises a series of individual equally spaced gas springs arranged in a circle around the actuator bowl between the chuck jaws with the cylinders of the springs embedded in the upper end of the actuator and their plungers or pistons engaging a fixed surface or pressure pad secured to the end of the spindle. This arrangement results in an extremely compact clamping system and with the gas springs which have identical strokes charged with the same gas pressure selected to give the desired jaw force, the clamping system is precisely balanced to provide a uniform gripping force around the drill rod. Moreover, this gripping force remains essentially constant for different drill rod sizes.

Figure 9A:
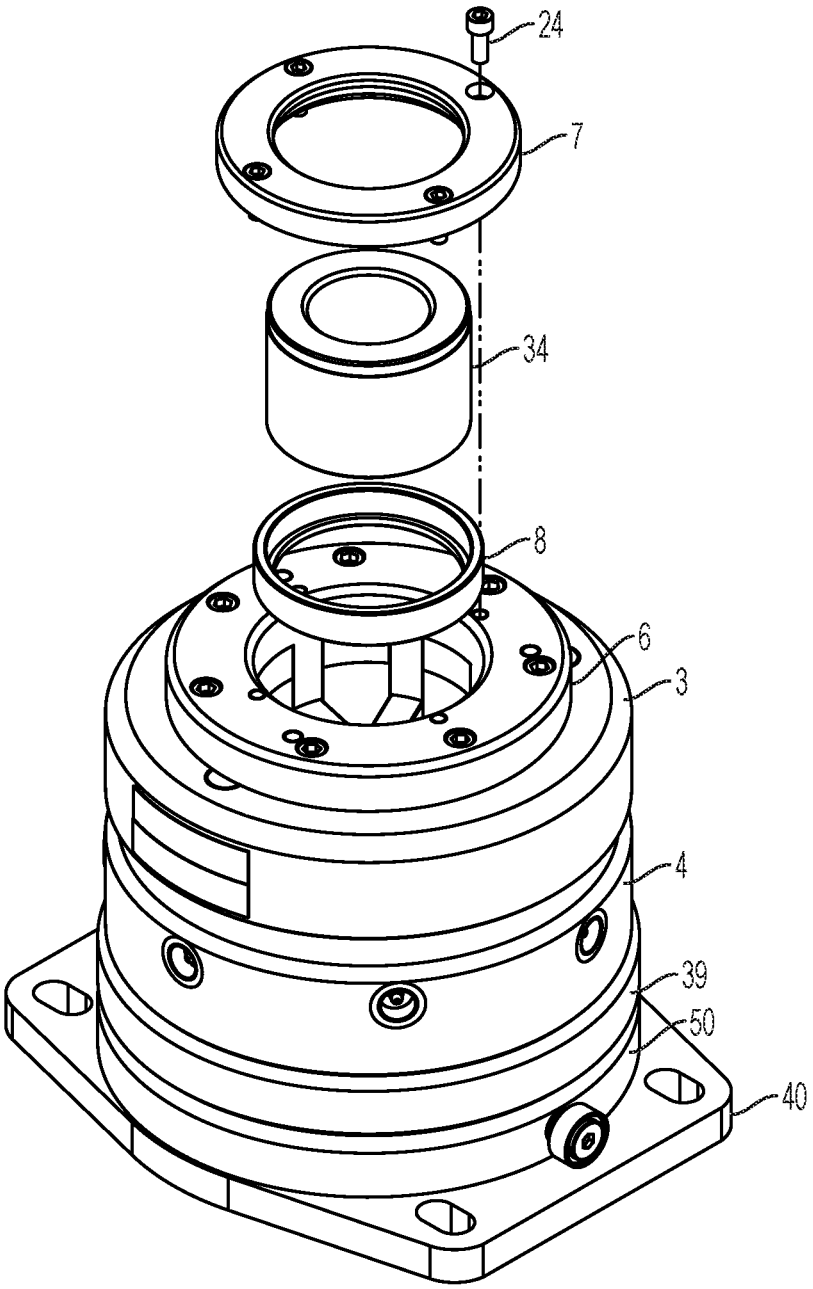
FIG. 9A is a perspective view depicting the attachment of a bushing assembly to the jaw retainer of an exemplary drill rod clamping system having a solid bushing as disclosed herein.
Figure 9B:
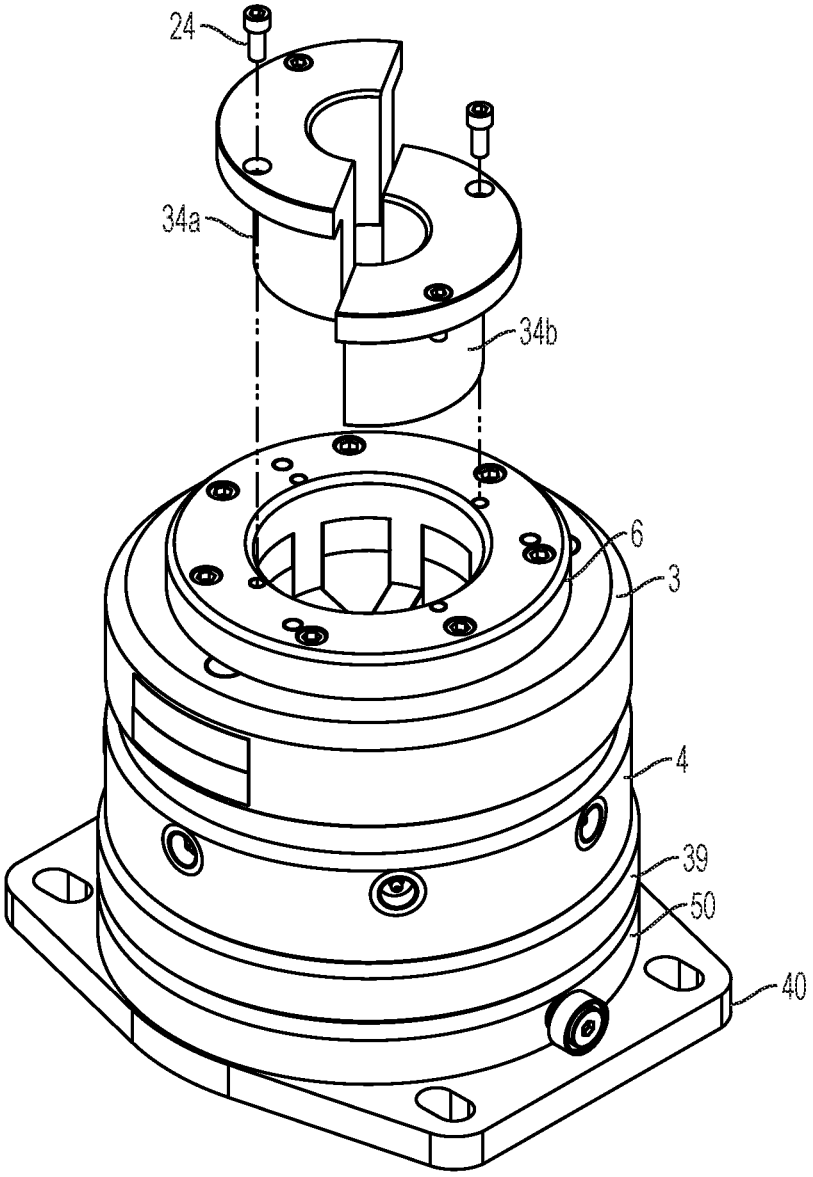
FIG. 9B is a perspective view depicting the attachment of a bushing assembly to the jaw retainer of an exemplary drill rod clamping system having a split, two-piece bushing as disclosed herein.
Figure 10:
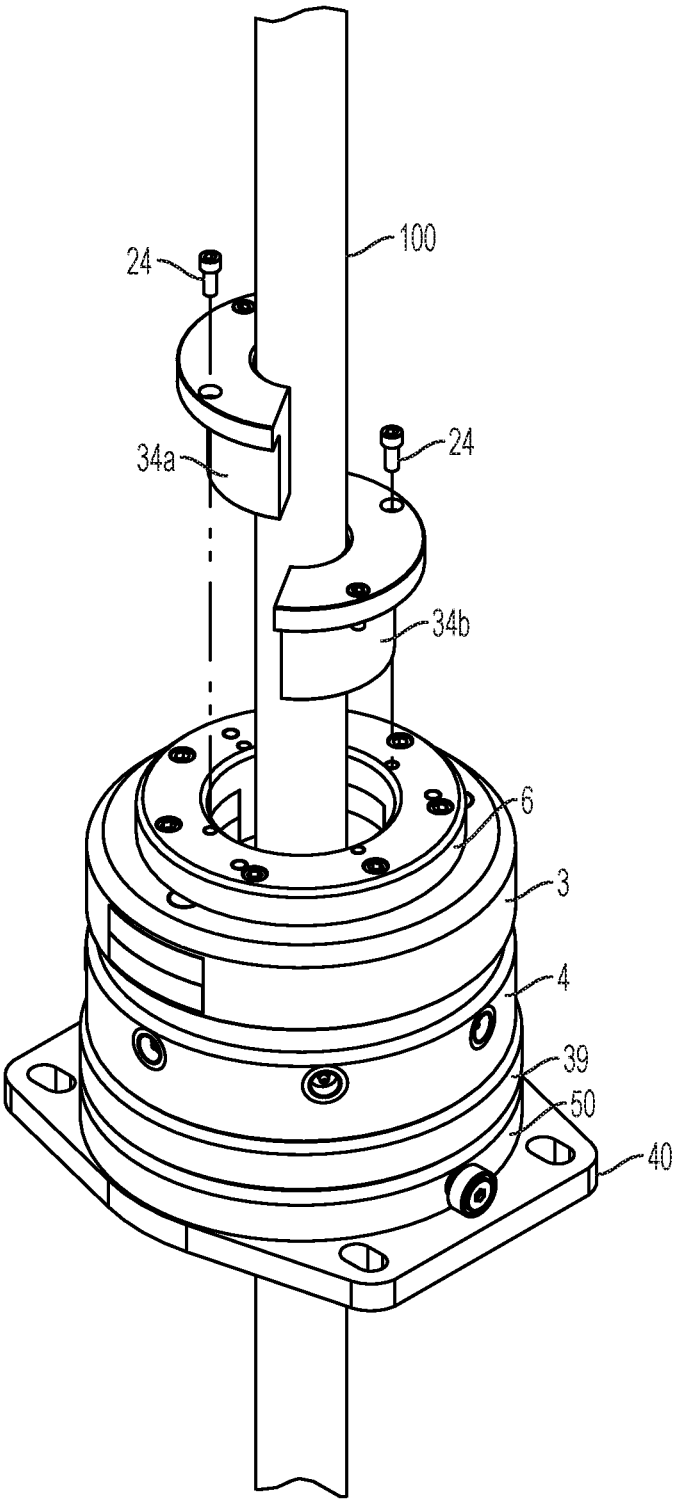
FIG. 10 is a perspective view of an exemplary drill rod clamping system having a split bushing that receives a drill rod as disclosed herein.

Optionally, the drill rod clamping system can comprise at least one bushing 34 to prevent the jaws from rocking or moving undesirably during use of the system. It is contemplated that each bushing 34 can have a central bore and can be selected for the size of the drill rod 100 to be driven. In exemplary aspects, an upper bushing 34 can be positioned (e.g., mounted) to extend into the spindle to overlie the top of the jaws, the arrangement being such that the jaws can slide radially in and out of rod gripping and rod releasing positions but are prevented from tipping either up or down. Optionally, in exemplary aspects, the bushing 34 can be provided as part of a bushing assembly that includes a bushing retainer 7 and a bushing holder 8 as shown in FIG. 9. In use, the bushing retainer 7 can define a central opening and be configured for positioning over a portion of the bushing 34 to secure the bushing in an operative axial position. The bushing retainer 7 can be secured to the jaw retainer 6 in a position in which the central opening of the bushing retainer is aligned with the bore of the bushing 34. The bushing holder 8 can define a central opening and be configured to receive a bottom portion of the bushing 34. In exemplary aspects, it is contemplated that the bushing holder can permit use of jaws and bushings that are sized for smaller diameter spindles of a chuck. In some exemplary aspects, as shown in FIG. 9A, it is contemplated that the bushing 34 can be a single-piece, solid bushing. Alternatively, in other exemplary aspects, and as shown in FIGS. 1A and 9B-10, it is contemplated that the bushing 34 can be a split bushing with at least two pieces 34*a*, 34*b* that can be selectively secured to the jaw retainer 6 to cooperatively form a circumferential enclosure or selectively disconnected from the jaw retainer 6 to space the pieces 34*a*, 34*b* apart as needed to accommodate oversized tooling (e.g., a drill rod 100) that may be inserted through the clamping system. Thus, when a split bushing is used, it is contemplated that the bushing retainer 7 can be eliminated, and the individual bushing pieces 34*a*, 34*b* can be secured directly to the jaw retainer 6.

To provide positive open and closing jaw movement under sliding movement of the ring actuator, according to the preferred form of the invention, the rear edges of the jaws are beveled outwardly from their upper end to their lower end preferably at an angle of 15 degrees and are provided with similarly slanted key ways in their side faces adjacent their rear edges. The actuator in turn can be provided with correspondingly slanted or beveled slots to receive the rear edges of the jaws with the side walls of the slots having projecting ribs or keys to engage in the jaw key ways. The walls of the slots themselves engage the sides of the jaws to preclude their twisting.

The disclosed rod clamping system also provides a jaw lubricating system which not only provides for lubrication of the jaws by also provides for lubricant flow between the jaws so that all jaws are properly lubricated at all times.

To ensure accurate relative positioning of the spindle, actuator, and other components at all times the invention also provides a guide pin arrangement which prevents jamming of the jaws so that they can easily be removed and replaced in the actuator bowl and to ensure that there is no misalignment of the springs. More particularly, it is contemplated that a plurality of pins 14 can be received within corresponding receptacles of the jaw bowl 4 and the gas spring retainer 3 to ensure proper alignment. Additionally, it is contemplated that each pin 14 can further comprise a seal 5 that prevents passage of material through the receptacles of the jaw bowl and the gas spring retainer.

Optionally, in still another aspect, the grippers (e.g., carbide grippers) in the jaws utilize an angled tooth pattern which increases the gripping strength of the jaws since each tooth has a separate "plow" path through the rod material. If the teeth are in-line, grip failure will occur when the material around each tooth deforms to the point where only the first tooth is in contact with parent rod material. In exemplary aspects, the grippers (e.g., gripping inserts) can comprise any number of materials that are wear resistant. For example, in one or more implementations the gripping inserts can comprise tungsten carbide inserts. Optionally, the gripping inserts of each jaw can be provided as a single insert or as a plurality of inserts, which can optionally be arranged in rows or other patterns. These arrangements can allow for increased frictional contact can provide better load transmission, thus increasing capacity and safety while decreasing wear on the associated components.

Figure 3:
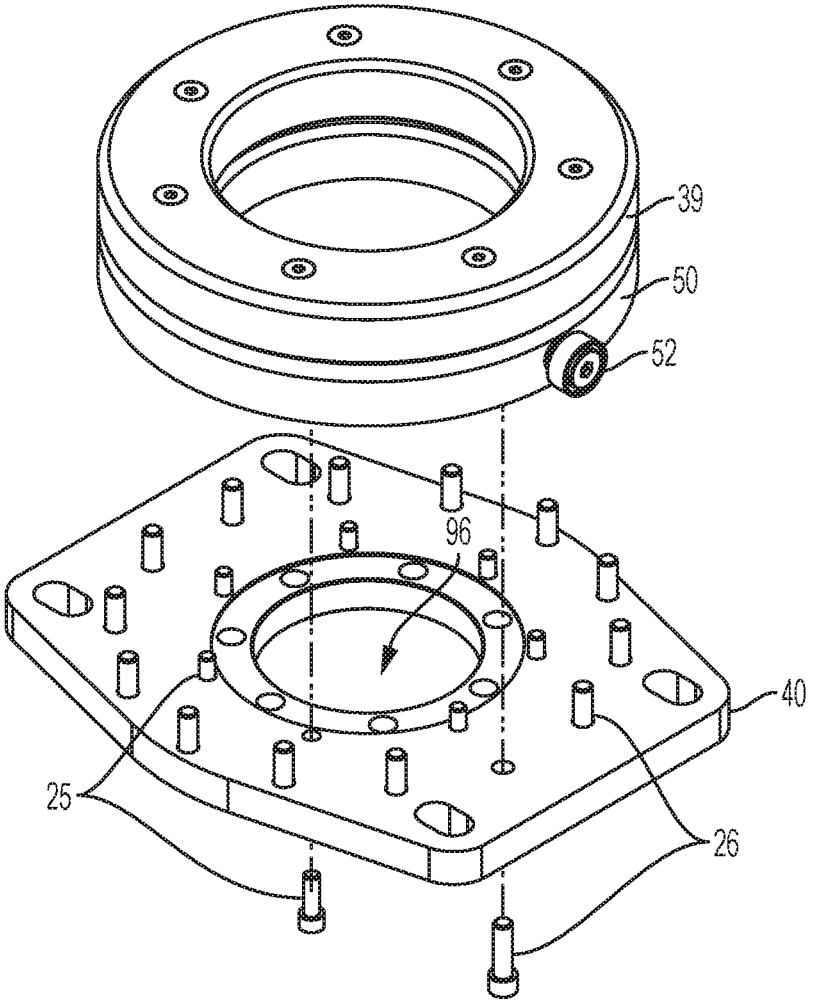
FIG. 3 is a perspective view depicting the attachment between a base plate and a ring cylinder of an exemplary drill rod clamping system as disclosed herein.
Figure 4:
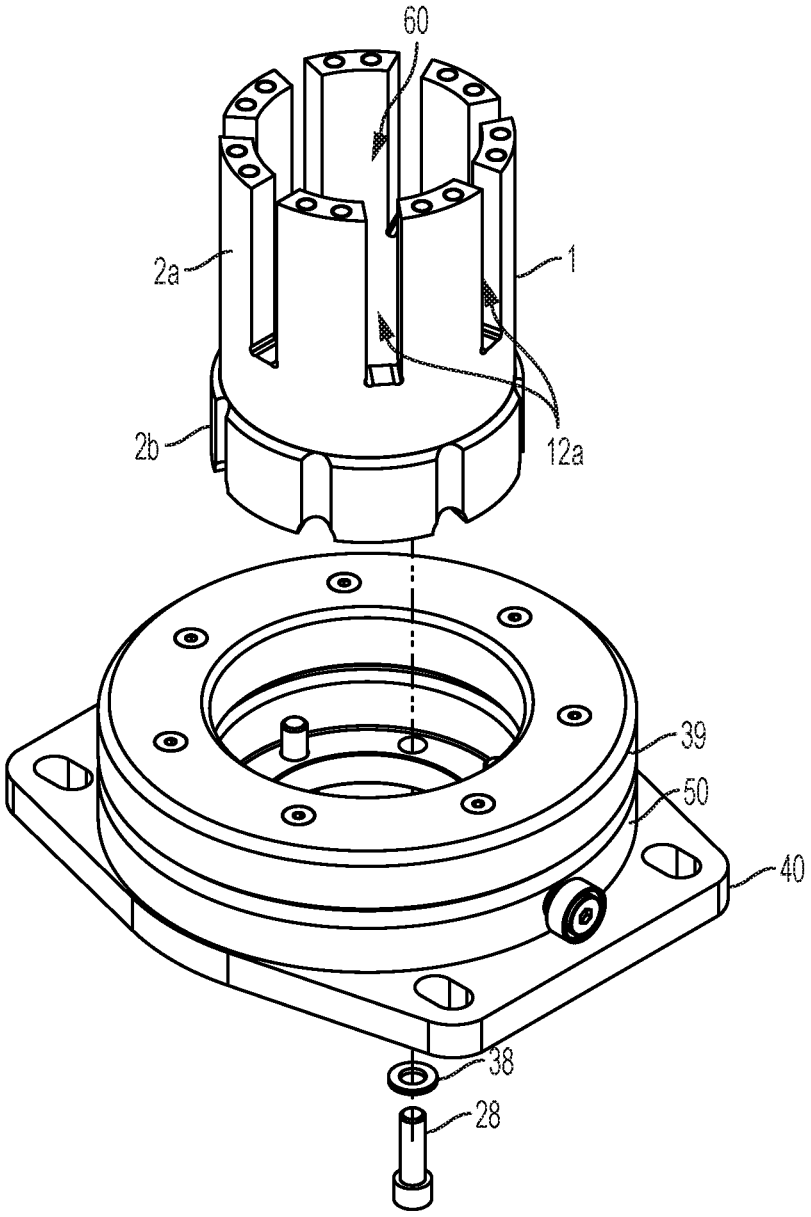
FIG. 4 is a perspective view depicting the attachment of a spindle to the base plate of an exemplary drill rod clamping system as disclosed herein.

In exemplary aspects, the various components of the drill rod clamping system 10 can be secured together using conventional fasteners 24, 25, 26, 27, 28, 29 as shown in FIGS. 1A-9. In these aspects, as shown in FIG. 3, fasteners 25 can extend through openings in the base plate and be used to secure the base plate 40 to an inner ring cylinder 84, whereas fasteners 26 can extend through openings in the base plate and be used to secure the base plate 40 to an outer ring cylinder 86 as disclosed herein. In further aspects, as shown in FIG. 4, fasteners 28 can extend through openings in the base plate that are circumferentially spaced around central opening 96 and be used to secure the spindle 1 to the base plate. In these aspects, it is contemplated that each fastener 28 can be used in conjunction with a washer 38 as is known in the art. In further aspects, as shown in FIG. 7, fasteners 27 can extend through openings in the top surface of the gas spring retainer 3 and be used to secure the gas spring retainer to the upper portion 2*a* of the spindle 1, which can define corresponding openings for receiving the fasteners. In still further aspects, as shown in FIG. 8, fasteners 29 can extend through openings in the top surface of the jaw retainer 6 and be used to secure the jaw retainer to the gas spring retainer 3, which can define corresponding openings for receiving the fasteners. In still further aspects, as shown in FIG. 9A, fasteners 24 can extend through openings in the bushing retainer 7 and be used to secure the bushing retainer to the jaw retainer 6, which can define corresponding openings for receiving the fasteners. In exemplary aspects, the fasteners disclosed herein can be screws or bolts as are known in the art.

In further exemplary aspects, as shown in FIG. 1A, an outer surface of the gas spring retainer 3 can be provided with a portion 41 that is configured to receive a decal or other indicia. Similarly, it is contemplated that the radial grease passageways 21 within the jaw bowl can be labeled using corresponding labels 19 adhered or otherwise secured to the outer surface 77 of the jaw bowl as shown in FIGS. 1A and 5.

Exemplary Aspects

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A drill rod clamping system for securing a drill rod in a selected position, the drill rod clamping system having a longitudinal axis and comprising: a hollow spindle having a central bore, an inner surface, an outer surface, a base portion and an upper portion extending upwardly from the base portion relative to the longitudinal axis, wherein the upper portion defines a plurality of axial slots that extend between the inner and outer surfaces of the hollow spindle, and wherein the base portion defines at least one opening that extends between the inner and outer surfaces of the hollow spindle; a plurality of jaws coupled to the spindle and being moveable radially inwardly to a closed drill rod gripping position and radially outwardly to an open drill rod releasing position, wherein each jaw is at least partially received within a respective axial slot of the upper portion of the hollow spindle; an actuator configured to move the plurality of jaws between the closed drill rod gripping position and the open drill rod releasing position; a compressed gas spring assembly configured to exert sufficient force on the actuator to close the jaws of the drill rod clamping system, the compressed gas spring assembly comprising a plurality of compressed gas springs, wherein each compressed gas spring comprises a cylinder containing compressed gas and a piston urged by the compressed gas outwardly of the cylinder to the end of its stroke; and a hydraulic operator configured to exert force on the actuator to overcome the force of the compressed gas spring assembly to effect opening of the jaws of the drill rod clamping system, wherein the at least one opening of the base portion of the hollow spindle is configured to permit flushing of material flowing within the central bore of the hollow spindle relative to the longitudinal axis.

Aspect 2: The drill rod clamping system of aspect 1, wherein each jaw of the plurality of jaws is mounted within a respective axial slot of the upper portion of the hollow spindle.

Aspect 3: The drill rod clamping system of aspect 1 or aspect 2, wherein the actuator comprises a bowl that is slideable relative to the plurality of jaws to open and close the jaws, wherein the bowl has an upper surface, and wherein the cylinders of the compressed gas springs of the compressed gas spring assembly are embedded in the upper surface of the bowl.

Aspect 4: The drill rod clamping system of aspect 3, further comprising a gas spring retainer that circumferentially surrounds the hollow spindle and at least partially encloses the compressed gas springs, wherein the gas spring retainer has an inner stop surface, and wherein the pistons of the compressed gas springs of the compressed gas spring assembly are configured to engage the stop surface to urge the actuator away from the stop surface to the jaw closing position.

Aspect 5: The drill rod clamping system of aspect 3 or aspect 4, wherein the actuator is slideably mounted on the spindle.

Aspect 6: The drill rod clamping system of any one of aspects 3-5, wherein the plurality of jaws and the actuator have complementary engagement portions that are arranged to provide inward radial movement to the jaws upon upward axial movement of the actuator and to maintain alignment of the jaws relative to the longitudinal axis.

Aspect 7: The drill rod clamping system of aspect 6, wherein the complementary engagement portions comprises inclined key ways defined by each jaw and complementary inclined keys defined by the actuator, wherein the inclined keys of the actuator are configured for sliding engagement with the key ways of the jaws.

Aspect 8: The drill rod clamping system of aspect 6, wherein the complementary engagement portions comprises inclined key ways defined by the actuator and complementary inclined keys defined by the plurality of jaws, wherein the inclined keys of the jaws are configured for sliding engagement with the key ways of the actuator.

Aspect 9: The drill rod clamping system of any one of aspects 4-8, further comprising a base plate secured to the base portion of the spindle, wherein the base plate defines a central opening positioned in alignment with the central bore of the spindle, and wherein the base plate extends radially outwardly from the outer surface of the base portion of the spindle.

Aspect 10: The drill rod clamping system of any one of aspects 4-9, wherein the jaw bowl has jaw receiving undercut slots for registering with the axial slots in the upper portion of the spindle, and wherein the jaws project through the spindle slots into the central bore of the spindle to grip a drill rod and to be withdrawn from the drill rod gripping position upon sliding motion of the jaw bowl.

Aspect 11: The drill rod clamping system of aspect 10, further comprising a jaw retainer having depending legs projecting downwardly for complementary receipt within the axial slots of the spindle to overlie the jaws and prevent upward movement thereof.

Aspect 12: A drill rod clamping system of aspect 10 or aspect 11, wherein the jaw bowl has an inner surface, an outer surface, and at least one radial grease feed passageway extending between the inner and outer surfaces and positioned in communication with the jaw receiving slots.

Aspect 13: A drill rod clamping system of aspect 12, wherein the jaw bowl defines a circumferential grease passageway, and wherein the jaw receiving slots are interconnected by the circumferential grease passageway.

Aspect 14: A drill rod clamping system of any one of aspects 10-13, wherein the jaw receiving slots of the jaw bowl and the plurality of jaws have complementary engagement portions, wherein downward movement of the jaw bowl positively advances the jaws into the drill rod gripping position, and wherein upward movement of the jaw bowl positively withdraws the jaws from the drill rod gripping position.

Aspect 15: A drill rod clamping system of aspect 14, further comprising a plurality of locating pins that are interposed between the jaw bowl and the gas spring retainer to locate the jaw bowl so that the jaw receiving slots complementarily register with the axial slots in the top portion of the spindle.

Aspect 16: A drill rod clamping system of aspect 15, wherein the jaws comprise grippers that are configured to grip a drill rod.

Aspect 17: The drill rod clamping system of aspect 16, wherein the grippers have an angled tooth pattern, and wherein the angled tooth pattern comprises a plurality of teeth that have respective plough paths through rod material when gripping a drill rod.

Aspect 18: The drill rod clamping system of any one of aspects 4-17, wherein the gas springs are configured to effect downward movement of the jaw bowl, and wherein the hydraulic operator is configured to effect upward movement of the jaw bowl.

Aspect 19: The drill rod clamping system of any one of aspects 4-18, wherein the drill rod clamping system does not rotate.

Aspect 20: The drill rod clamping system of any one of aspects 4-19, wherein, upon deactivation of the hydraulic operator, the force exerted by the hydraulic operator on the actuator is removed to allow the compressed gas spring assembly to drive the plurality of jaws to the drill rod gripping position.

Aspect 21: The drill rod clamping system of any one of aspects 4-20, wherein the actuator comprises an inner ring cylinder that circumferentially surrounds the base portion of the spindle, an outer ring cylinder that circumferentially surrounds the inner ring cylinder, and a ring cylinder piston positioned radially between the inner and outer ring cylinders, wherein the ring cylinder piston is configured for upward and downward movement relative to the longitudinal axis to selectively engage the gas springs.

Aspect 22: The drill rod clamping system of aspect 21, further comprising a ring cylinder cover positioned between the actuator and the jaw bowl, wherein the ring cylinder circumferentially surrounds the spindle and is configured to direct material radially inwardly and away from the ring cylinder piston.

Aspect 23: The drill rod clamping system of aspect 21 or aspect 22, wherein the actuator is selectively replaceable independently of the other components of the drill rod clamping system.

Aspect 24: The drill rod clamping system of any one of aspects 4-20, wherein the actuator comprises: a ring cylinder that circumferentially surrounds the base portion of the spindle; and a ring cylinder piston configured for upward and downward movement relative to the longitudinal axis to selectively engage the gas springs.

Aspect 25: The drill rod clamping system of aspect 24, further comprising a ring cylinder cover positioned between the actuator and the jaw bowl, wherein the ring cylinder circumferentially surrounds the spindle and is configured to direct material radially inwardly and away from the ring cylinder piston.

Aspect 26: The drill rod clamping system of aspect 24 or aspect 25, wherein the actuator is selectively replaceable independently of the other components of the drill rod clamping system.

Aspect 27: The drill rod clamping system of any one of the preceding aspects, wherein the drill rod clamping system does not comprise an external actuator.

Aspect 28: The drill rod clamping system of any one of the preceding aspects, wherein the at least one opening of the base portion of the spindle comprises a plurality of circumferentially spaced openings.

Aspect 29: The drill rod clamping system of aspect 28, wherein the base portion of the spindle comprises a distal surface, and wherein each opening of the base portion of the spindle comprises a slot that extends upwardly from the distal surface of the base portion of the spindle.

Aspect 30: The drill rod clamping system of any one of aspects 11-29, further comprising a bushing positioned at least partially within the spindle and overlying the plurality of jaws, wherein the bushing is configured to allow the jaws to move radially inwardly to a closed drill rod gripping position and radially outwardly to an open drill rod releasing position but to prevent the jaws from tipping in an upward or downward direction.

Aspect 31: The drill rod clamping system of aspect 30, wherein the bushing is a split bushing comprising at least two pieces that are configured to be selectively secured to the jaw retainer to cooperatively form a circumferential enclosure.

Aspect 32: A method of securing a drill rod in a desired axial position, comprising: using the drill rod clamping system of any one of aspects 1-31 to grip the drill rod.

Aspect 33: The method of aspect 32, wherein radial movement of the jaws into the drill rod gripping position is determined by the diameter of the drill rod being gripped.

Aspect 34: The method of aspect 32, further comprising disengaging the drill rod by activating the hydraulic operator.

All publications and patent applications mentioned in the specification are indicative of the level of those skilled in the art to which this invention pertains. All publications and patent applications are herein incorporated by reference to the same extent as if each individual publication or patent application was specifically and individually indicated to be incorporated by reference.

Although the foregoing invention has been described in some detail by way of illustration and example for purposes of clarity of understanding, certain changes and modifications may be practiced within the scope of the appended claims.

What is claimed is:

1. A drill rod clamping system for securing a drill rod in a selected position, the drill rod clamping system having a longitudinal axis and comprising:

a hollow spindle having a central bore, an inner surface, an outer surface, a base portion and an upper portion extending upwardly from the base portion relative to the longitudinal axis, wherein the upper portion defines a plurality of axial slots that extend between the inner and outer surfaces of the hollow spindle;

a plurality of jaws coupled to the spindle and being moveable radially inwardly to a closed drill rod gripping position and radially outwardly to an open drill rod releasing position, wherein each jaw is at least partially received within a respective axial slot of the plurality of axial slots of the upper portion of the hollow spindle;

an actuator configured to move the plurality of jaws between the closed drill rod gripping position and the open drill rod releasing position;

a compressed gas spring assembly configured to exert sufficient force on the actuator to close the jaws of the drill rod clamping system, wherein the compressed gas spring assembly comprises a plurality of compressed gas springs, and wherein each compressed gas spring comprises a cylinder containing compressed gas and a piston urged by the compressed gas outwardly of the cylinder to the end of its stroke; and a hydraulic operator configured to exert force on the actuator to overcome the force of the compressed gas spring assembly to effect opening of the jaws of the drill rod clamping system.

2. The drill rod clamping system of claim 1, wherein the base portion defines at least one opening that extends between the inner and outer surfaces of the hollow spindle, wherein the at least one opening of the base portion of the hollow spindle is configured to permit flushing of material flowing within the central bore of the hollow spindle relative to the longitudinal axis.

3. The drill rod clamping system of claim 1, wherein the actuator comprises a jaw bowl that is slideable relative to the plurality of jaws to open and close the jaws, wherein the jaw bowl has an upper surface, and wherein the cylinders of the compressed gas springs of the compressed gas spring assembly are embedded in the upper surface of the jaw bowl.

4. The drill rod clamping system of claim 3, further comprising a gas spring retainer that circumferentially surrounds the hollow spindle and at least partially encloses the compressed gas springs, wherein the gas spring retainer has an inner stop surface, and wherein the pistons of the compressed gas springs of the compressed gas spring assembly are configured to engage the stop surface to urge the actuator away from the stop surface to the jaw closing position.

5. The drill rod clamping system of claim 4, further comprising a base plate secured to the base portion of the spindle, wherein the base plate defines a central opening positioned in alignment with the central bore of the spindle, and wherein the base plate extends radially outwardly from the outer surface of the base portion of the spindle.

6. The drill rod clamping system of claim 4, wherein the jaw bowl has jaw receiving undercut slots for registering with the axial slots in the upper portion of the spindle, and wherein the jaws project through the spindle slots into the central bore of the spindle to grip a drill rod and to be withdrawn from the drill rod gripping position upon sliding motion of the jaw bowl.

7. The drill rod clamping system of claim 6, further comprising a jaw retainer having depending legs projecting downwardly for complementary receipt within the axial slots of the spindle to overlie the jaws and prevent upward movement thereof.

8. A drill rod clamping system of claim 6, wherein the jaw bowl has an inner surface, an outer surface, and at least one radial grease feed passageway extending between the inner and outer surfaces of the jaw bowl and positioned in communication with the jaw receiving slots.

9. A drill rod clamping system of claim 8, wherein the jaw bowl defines a circumferential grease passageway, and wherein the jaw receiving slots are interconnected by the circumferential grease passageway.

10. A drill rod clamping system of claim 6, wherein the jaw receiving slots of the jaw bowl and the plurality of jaws have complementary engagement portions, wherein downward movement of the jaw bowl positively advances the jaws into the drill rod gripping position, and wherein upward movement of the jaw bowl positively withdraws the jaws from the drill rod gripping position.

11. A drill rod clamping system of claim 10, further comprising a plurality of locating pins that are interposed between the jaw bowl and the gas spring retainer to locate the jaw bowl so that the jaw receiving slots complementarily register with the axial slots in the top portion of the spindle.

12. A drill rod clamping system of claim 11, wherein the jaws comprise grippers that are configured to grip the drill rod.

13. The drill rod clamping system of claim 12, wherein the grippers have an angled tooth pattern, and wherein the angled tooth pattern comprises a plurality of teeth that have respective plough paths through rod material when gripping the drill rod.

14. The drill rod clamping system of claim 4, wherein the gas springs are configured to effect downward movement of the jaw bowl, and wherein the hydraulic operator is configured to effect upward movement of the jaw bowl.

15. The drill rod clamping system of claim 4, wherein the actuator comprises an inner ring cylinder that circumferentially surrounds the base portion of the spindle, an outer ring cylinder that circumferentially surrounds the inner ring cylinder, and a ring cylinder piston positioned radially between the inner and outer ring cylinders, wherein the ring cylinder piston is configured for upward and downward movement relative to the longitudinal axis to selectively engage the gas springs.

16. The drill rod clamping system of claim 4, wherein the actuator comprises:

a ring cylinder that circumferentially surrounds the base portion of the spindle; and a ring cylinder piston configured for upward and downward movement relative to the longitudinal axis to selectively engage the gas springs.

17. The drill rod clamping system of claim 3, wherein the plurality of jaws and the actuator have complementary engagement portions that are arranged to provide inward radial movement to the jaws upon upward axial movement of the actuator and to maintain alignment of the jaws relative to the longitudinal axis.

18. The drill rod clamping system of claim 17, wherein the complementary engagement portions comprises inclined key ways defined by each jaw and complementary inclined keys defined by the actuator, wherein the inclined keys of the actuator are configured for sliding engagement with the key ways of the jaws.

19. The drill rod clamping system of claim 17, wherein the complementary engagement portions comprises inclined key ways defined by the actuator and complementary inclined keys defined by the plurality of jaws, wherein the inclined keys of the jaws are configured for sliding engagement with the key ways of the actuator.

20. A drill rod clamping system for securing a drill rod in a selected position, the drill rod clamping system having a longitudinal axis and comprising:

a hollow spindle having a central bore, an inner surface, an outer surface, a base portion and an upper portion extending upwardly from the base portion relative to the longitudinal axis, wherein the upper portion defines a plurality of axial slots that extend between the inner and outer surfaces of the hollow spindle;

a plurality of jaws coupled to the spindle and being moveable radially inwardly to a closed drill rod gripping position and radially outwardly to an open drill rod releasing position, wherein each jaw is at least partially received within a respective axial slot of the plurality of axial slots of the upper portion of the hollow spindle;

an actuator configured to move the plurality of jaws between the closed drill rod gripping position and the open drill rod releasing position;

a compressed gas spring assembly configured to exert sufficient force on the actuator to close the jaws of the drill rod clamping system; and a hydraulic operator configured to exert force on the actuator to overcome the force of the compressed gas spring assembly to effect opening of the jaws of the drill rod clamping system, wherein the base portion defines at least one opening that extends radially between the inner and outer surfaces of the hollow spindle, wherein the at least one opening of the base portion of the hollow spindle is configured to permit flushing of material flowing within the central bore of the hollow spindle relative to the longitudinal axis.

* * * * *